US011084610B2

(12) United States Patent
Boss et al.

(10) Patent No.: US 11,084,610 B2
(45) **Date of Patent: *Aug. 10, 2021**

(54) ELECTRICALLY POWERED COMBINATION HAND-HELD STRAPPING TOOL

(71) Applicant: Signode Industrial Group LLC, Glenview, IL (US)

(72) Inventors: Walter L. Boss, Lindenhurst, IL (US); Janusz Figiel, Mundelein, IL (US)

(73) Assignee: Signode Industrial Group LLC, Glenview, IL (US)

( * ) Notice: Subject to any disclaimer, the term of this patent is extended or adjusted under 35 U.S.C. 154(b) by 268 days.

This patent is subject to a terminal disclaimer.

(21) Appl. No.: 16/386,622

(22) Filed: Apr. 17, 2019

(65) Prior Publication Data

US 2019/0241292 A1 Aug. 8, 2019

Related U.S. Application Data

(63) Continuation of application No. 14/736,383, filed on Jun. 11, 2015, now Pat. No. 10,308,383.

(Continued)

(51) Int. Cl.
*B65B 13/18* (2006.01)
*B65B 13/22* (2006.01)

(Continued)

(52) U.S. Cl.
CPC ..... *B65B 13/22* (2013.01); *B65B 13/025* (2013.01); *B65B 13/187* (2013.01);

(Continued)

(58) Field of Classification Search
CPC ..... B65B 13/22; B65B 13/025; B65B 13/187; B65B 13/305; B65B 57/00; B65B 57/18; B65B 2210/12

(Continued)

(56) References Cited

U.S. PATENT DOCUMENTS 5,694,984 A 12/1997 Cheung
6,079,457 A 6/2000 Crittenden (Continued)

FOREIGN PATENT DOCUMENTS

CN 1134903 C 1/2004
CN 101678903 A 3/2010

(Continued)

OTHER PUBLICATIONS

International Preliminary Report on Patentability issued by the ISA/EPO in connection with PCT/US2015/035477 dated Jan. 24, 2017.

(Continued)

*Primary Examiner* — Jimmy T Nguyen
(74) *Attorney, Agent, or Firm* — Neal, Gerber & Eisenberg LLP

(57) ABSTRACT

An electrically powered strapping tool for tensioning and forming a sealless joint in overlapping sections of steel strap around a load includes a body having a foot, a tensioning assembly operably mounted to the body, the tensioning assembly having an electrically powered motor and a tensioning wheel operably connected to the tensioner motor. The tool includes a sealing assembly operably mounted to the body, the sealing assembly having an electrically powered motor and a sealer operably connected to the electrically powered motor. A control system controls operation of the tensioning assembly and the sealing assembly to operate the strapping tool in an automatic mode in which the tensioning assembly and the sealing assembly are sequentially actuated by a single action of the control system by an operator, and in a manual mode in which the tensioning assembly and the sealing assembly are sequentially actuated by multiple actions of the control system by the operator.

20 Claims, 7 Drawing Sheets

Related U.S. Application Data

(60) Provisional application No. 62/026,865, filed on Jul. 21, 2014.

(51) Int. Cl.

| | |
|---|---|
| ***B65B 13/30*** | (2006.01) |
| ***B65B 13/02*** | (2006.01) |
| ***B65B 57/00*** | (2006.01) |
| ***B65B 57/18*** | (2006.01) |

(52) U.S. Cl.
CPC ..... *B65B 13/305* (2013.01); *B65B 57/00* (2013.01); *B65B 57/18* (2013.01); *B65B 2210/12* (2013.01)

(58) Field of Classification Search
USPC ..... 100/4, 18, 29, 32; 140/93.2, 152
See application file for complete search history.

(56) References Cited

U.S. PATENT DOCUMENTS

| | | | | |
|---|---|---|---|---|
| 6,338,375 | B1 | 1/2002 | Harada | |
| 6,772,798 | B2 * | 8/2004 | Cheung | B65B 13/305 140/152 |
| 6,966,255 | B1 | 11/2005 | Crittenden | |
| 7,556,129 | B2 | 7/2009 | Nix | |
| 8,281,711 | B2 | 10/2012 | Haberstroh | |
| 10,308,383 | B2 * | 6/2019 | Boss | B65B 13/187 |
| 2007/0261754 | A1 * | 11/2007 | Crittenden | B65B 13/305 140/93.2 |

FOREIGN PATENT DOCUMENTS

| | | | |
|---|---|---|---|
| EP | 2711301 | A1 | 3/2014 |
| WO | 2016014167 | A1 | 1/2016 |

OTHER PUBLICATIONS

International Search Report and Written Opinion of the ISA in connection with PCT/US2015/035477 dated Jan. 5, 2016.

* cited by examiner

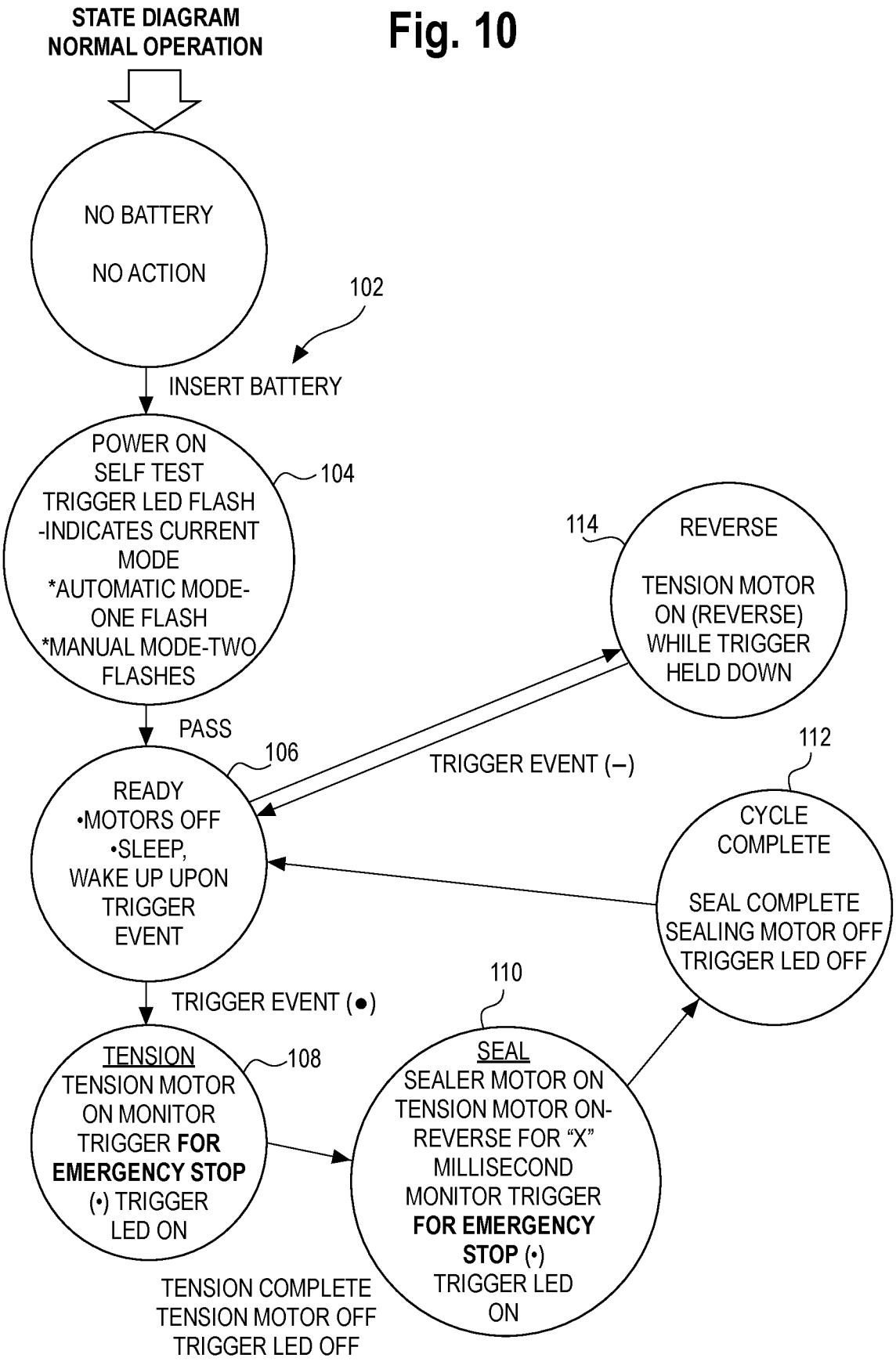
STATE DIAGRAM
NORMAL OPERATION
Fig. 10
NO BATTERY
NO ACTION
102
INSERT BATTERY
POWER ON
SELF TEST
TRIGGER LED FLASH
-INDICATES CURRENT MODE
*AUTOMATIC MODE-ONE FLASH
*MANUAL MODE-TWO FLASHES
104
PASS
114
REVERSE
TENSION MOTOR ON (REVERSE) WHILE TRIGGER HELD DOWN
106
TRIGGER EVENT (–)
112
READY
•MOTORS OFF
•SLEEP,
WAKE UP UPON TRIGGER EVENT
CYCLE COMPLETE
SEAL COMPLETE
SEALING MOTOR OFF
TRIGGER LED OFF
110
TRIGGER EVENT (•)
TENSION
TENSION MOTOR ON MONITOR TRIGGER FOR EMERGENCY STOP (•) TRIGGER LED ON
108
SEAL
SEALER MOTOR ON
TENSION MOTOR ON-REVERSE FOR "X" MILLISECOND
MONITOR TRIGGER FOR EMERGENCY STOP (•)
TRIGGER LED ON
TENSION COMPLETE
TENSION MOTOR OFF
TRIGGER LED OFF

ELECTRICALLY POWERED COMBINATION HAND-HELD STRAPPING TOOL

CROSS-REFERENCE TO RELATED APPLICATION DATA

This application claims the benefit of and priority to US Provisional U.S. Patent Application Ser. No. 62/026,865, filed Jul. 21, 2014, the disclosure of which is incorporated herein in its entirety.

BACKGROUND

Strapping tools or strappers come in a wide variety of types, from fully manual hand tools to automatic, table-top machines. Strapping tools can be designed and intended for use with different types of strap or strapping materials, such as metal strapping or plastic/polymeric strapping. Strappers for metal strapping materials can be automatic table-top or hand-held devices that are configured to seal the strap onto itself. The sealing function can be performed using a sealless configuration by forming interlocking keys in overlapping courses of the strap, or by applying a seal that is positioned over and crimped onto the overlapping strap courses.

There are two types of known hand-held devices for steel strap: manual tools that require an operator to exert one or more forces to tension the strap and form the seal; and pneumatically operated tools that perform the tension and sealing functions by actuation of one or more pneumatic motors. The manual tools can be fatiguing to operate for long periods of time and may be difficult to maneuver and manipulate in certain instances, for example when the seal is formed on the side of a package or load. Moreover, manual sealing typically requires multiple tools to tension the strap, form the seal and cut the sealed strap from its source.

Pneumatic tools, such as that disclosed in Crittenden, U.S. Pat. No. 6,079,457, commonly assigned with the present application and incorporated herein in its entirety by reference, function well; however, they require a source of compressed gas, such as air, and thus necessitate the use of hoses, compressed gas fittings and the like for operation. As such, the use of pneumatic tools may be limited in certain applications where, for example, the strapping operations are carried out at different locations throughout a manufacturing facility. Moreover, pneumatic tools employ pneumatic motors which can be costly, and pneumatic circuits which can be complex and require casting and machining operations in the manufacture of pneumatic circuit modules.

Accordingly, there is a need for a powered strapping tool that functions to tension strap around a load, form a seal in the overlapping courses of strap material and cut the sealed strap from its source. Desirably, such a tool is self-contained, is electrically and/or battery powered, and is thus portable and can be used throughout a facility at any location. More desirably still, such a tool can be used in a variety of operating modes.

SUMMARY

Various embodiments of the present disclosure provide a strapping tool for tensioning and forming a sealless joint in overlapping sections of steel strap around a load that includes a body having a foot, a tensioning assembly operably mounted to the body and a sealing assembly operably mounted to the body. The tensioning and sealing assemblies have electrically powered motors.

A tensioning wheel is operably connected to the tensioner motor and a sealer is operably connected to the sealer motor. The tool includes a control system for controlling operation of the tensioning assembly and the sealing assembly. The control system is configured to operate the strapping tool in an automatic mode in which the tensioning assembly and the sealing assembly are sequentially actuated by, for example, a single action of the control system by an operator, and in a manual mode in which the tensioning assembly and the sealing assembly are sequentially actuated by multiple actions of the control system by the operator.

In an embodiment, the sealing assembly includes a die and punch cooperating with one another to cut keys in the overlapping sections of strap. The tensioner motor is operated in a reverse direction following a sealing cycle to interlock the keys cut in the overlapping sections of strap. The control system, in the automatic mode, is configured to operate in the reverse direction following the sealing assembly actuation by action of the control system to interlock the keys. In an embodiment the action can be carried out by a single action of the control system.

In an embodiment, the tensioner motor assembly is pivotally mounted to the body and is biased to move the tension wheel toward the foot.

In an embodiment, a cam shaft is operably connected to the die and includes a position switch for sensing a position of the cam shaft. The position switch is operably connected to the control system. An embodiment of the tool includes a dynamic brake to stop rotation of the sealer motor assembly at an end of the sealing cycle. The dynamic brake can be controlled by the control system.

The tool includes an actuation switch for controlling the tool. The actuation switch is operably connected to the control system which is operably connected to the tensioner motor assembly and the sealer motor assembly. The control system can include a strap tension adjusting device for varying a tension in the overlapping sections of steel strap. The control system can be configure to stop movement of the tensioning wheel based upon a setting of the strap tension adjusting device.

A control system controls a strapping tool of the type for tensioning and forming a sealless joint in overlapping sections of steel strap around a load. The control system includes control circuitry operably connected to the tensioner motor assembly and the sealer motor assembly. In an embodiment, a position switch is operably connected to the sealer to determine a position of the seal. The control system includes an actuation switch. The control system is configured to operate the strapping tool in an automatic mode in which the tensioner motor assembly and the sealer motor assembly are sequentially actuated by a single action of the actuation switch. In an embodiment, the control system is operably connected to a dynamic brake to stop movement of the sealer motor assembly when the sealer reaches a predetermined position.

In an embodiment, following a sealing cycle, the control system actuates the tensioner motor assembly in a reverse direction to secure the sealless joint.

In a manual mode the tensioner motor assembly and the sealer motor assembly are sequentially actuated by multiple actions of the actuation switch.

Other objects, features, and advantages of the disclosure will be apparent from the following description, taken in conjunction with the accompanying sheets of drawings, wherein like numerals refer to like parts, elements, components, steps, and processes.

BRIEF DESCRIPTION OF THE DRAWINGS

FIG. 10 is an example of a control and operating scheme for the tool.

DETAILED DESCRIPTION

Figure 1:
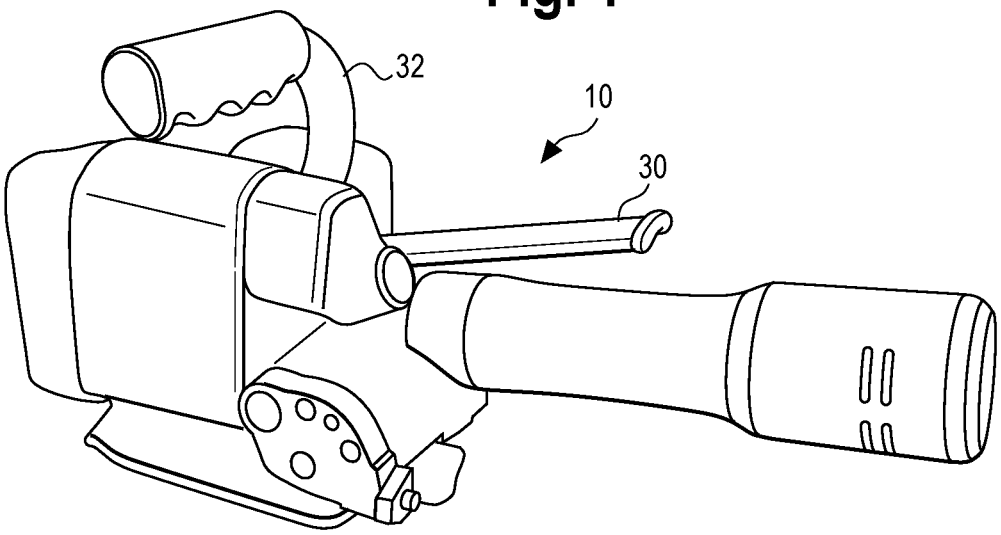
FIG. 1 is perspective view of an embodiment of an electrically powered combination strapping tool.
Figure 2:
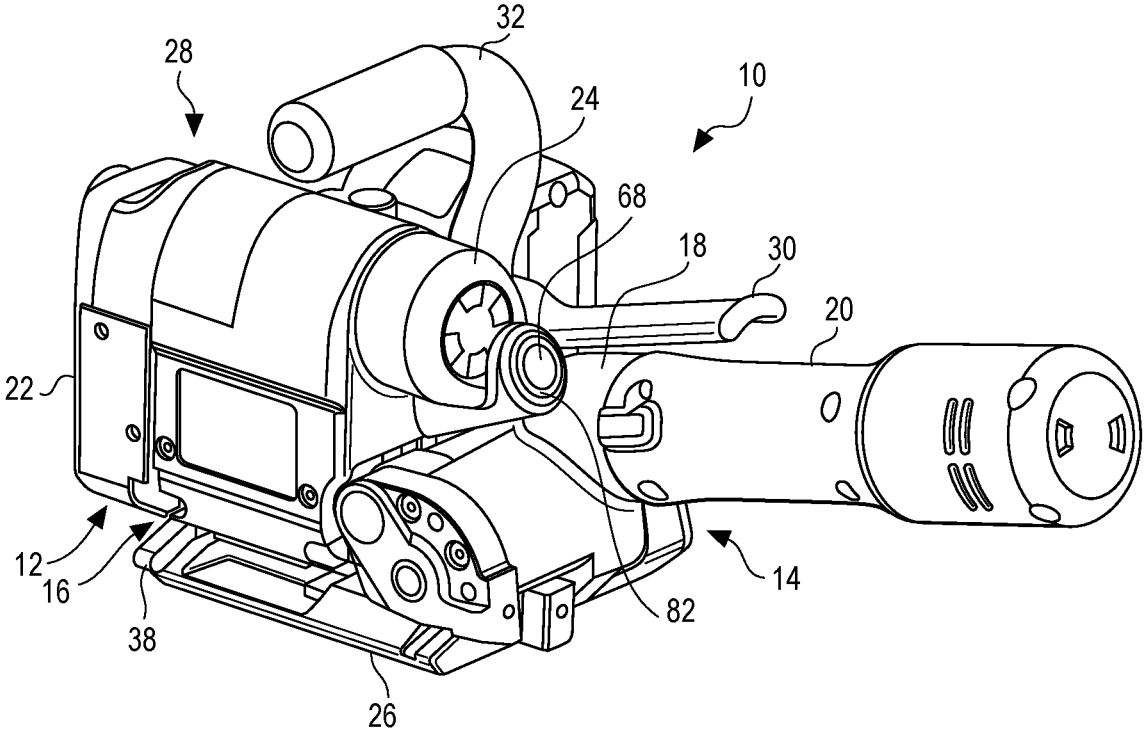
FIG. 2 is another perspective view of the tool.
Figure 3:
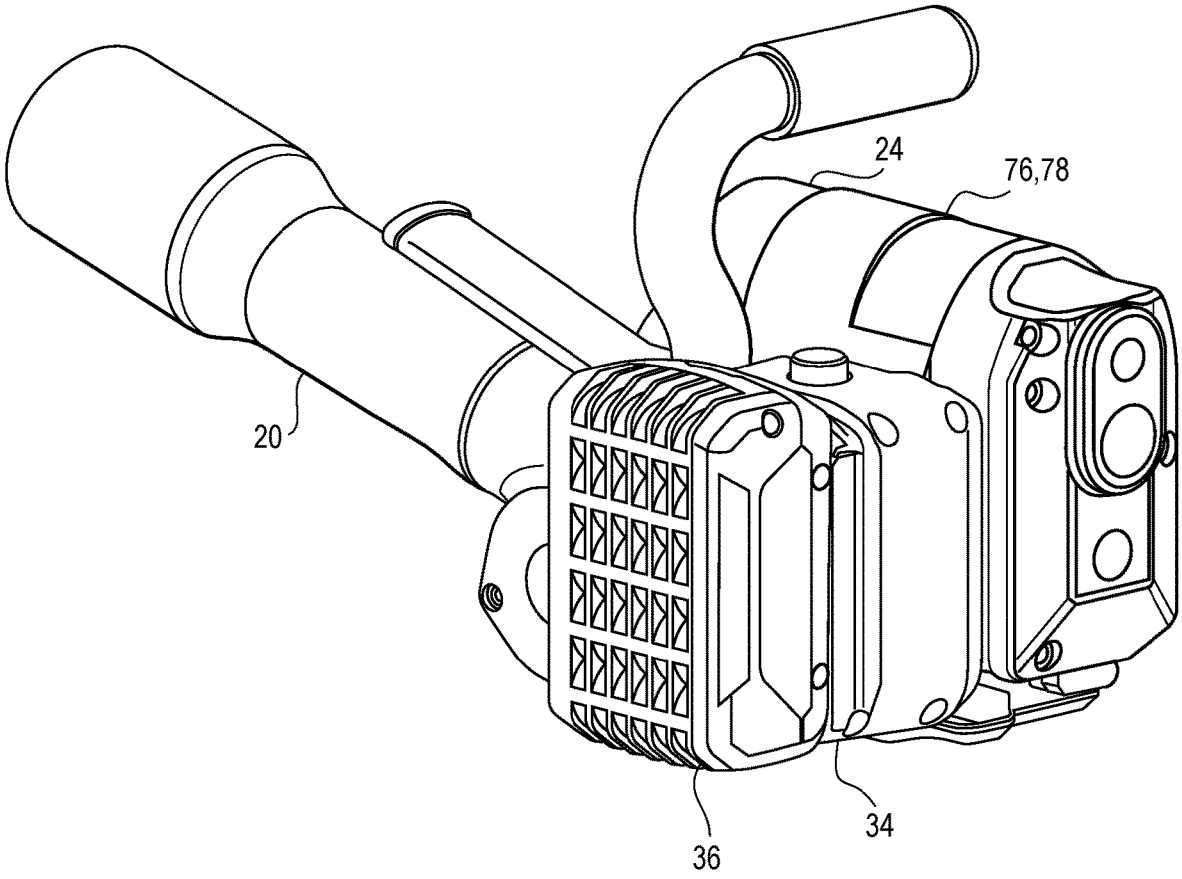
FIG. 3 a rear perspective view of the tool.
Figure 4:
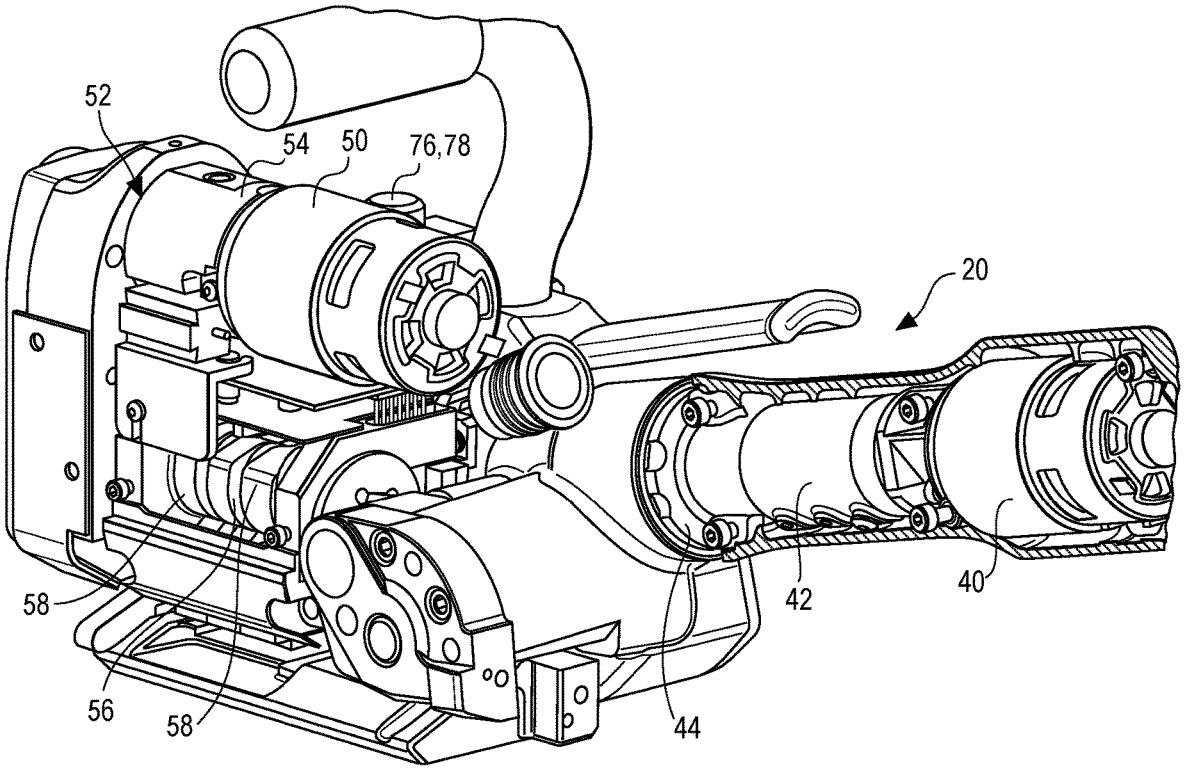
FIG. 4 is a perspective view similar to FIG. 2 showing portions of the housing removed for clarity of illustration.
Figure 5:
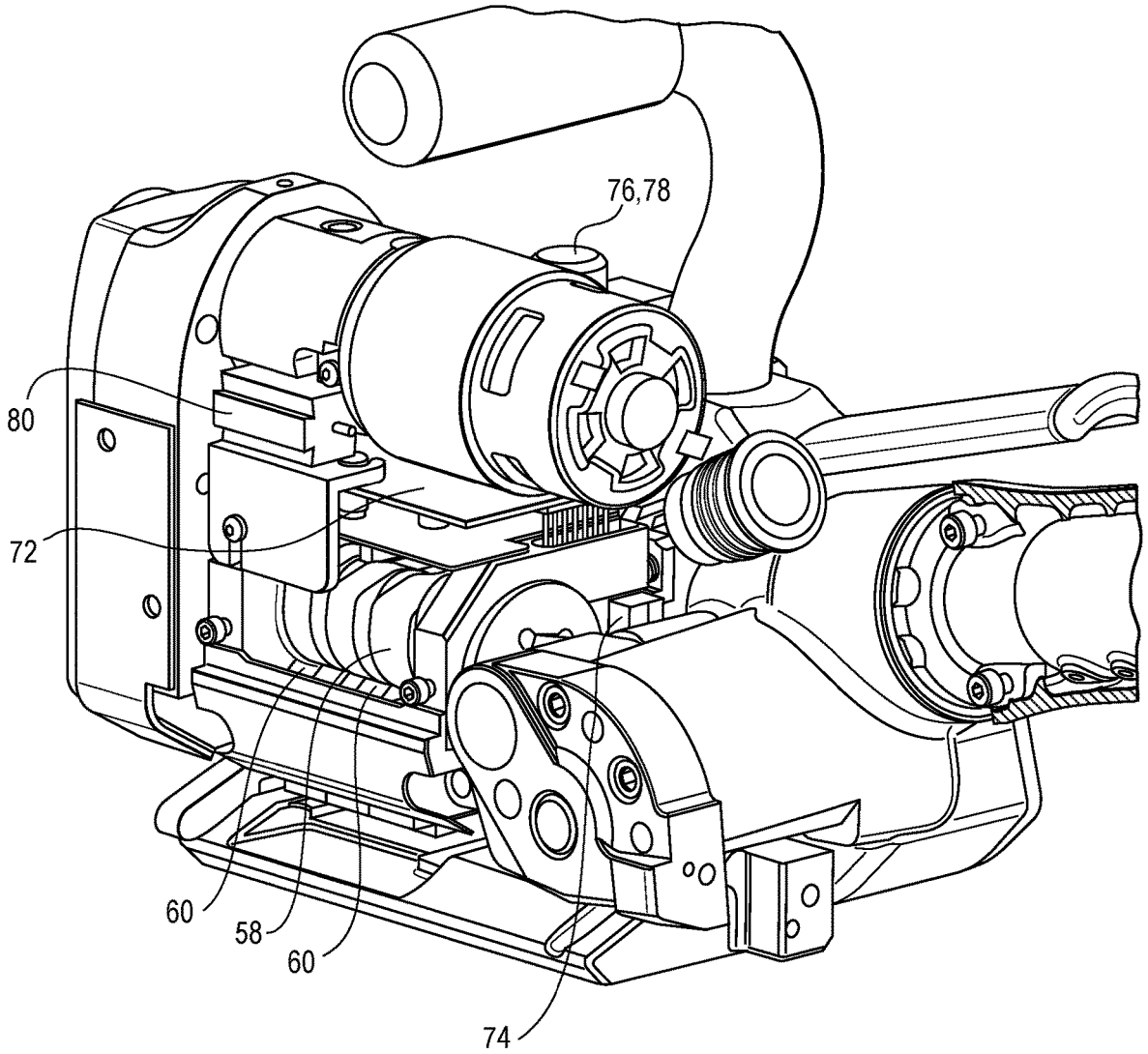
FIG. 5 is an enlarged perspective view of the tool illustrating various components and features of the tool.
Figure 6:
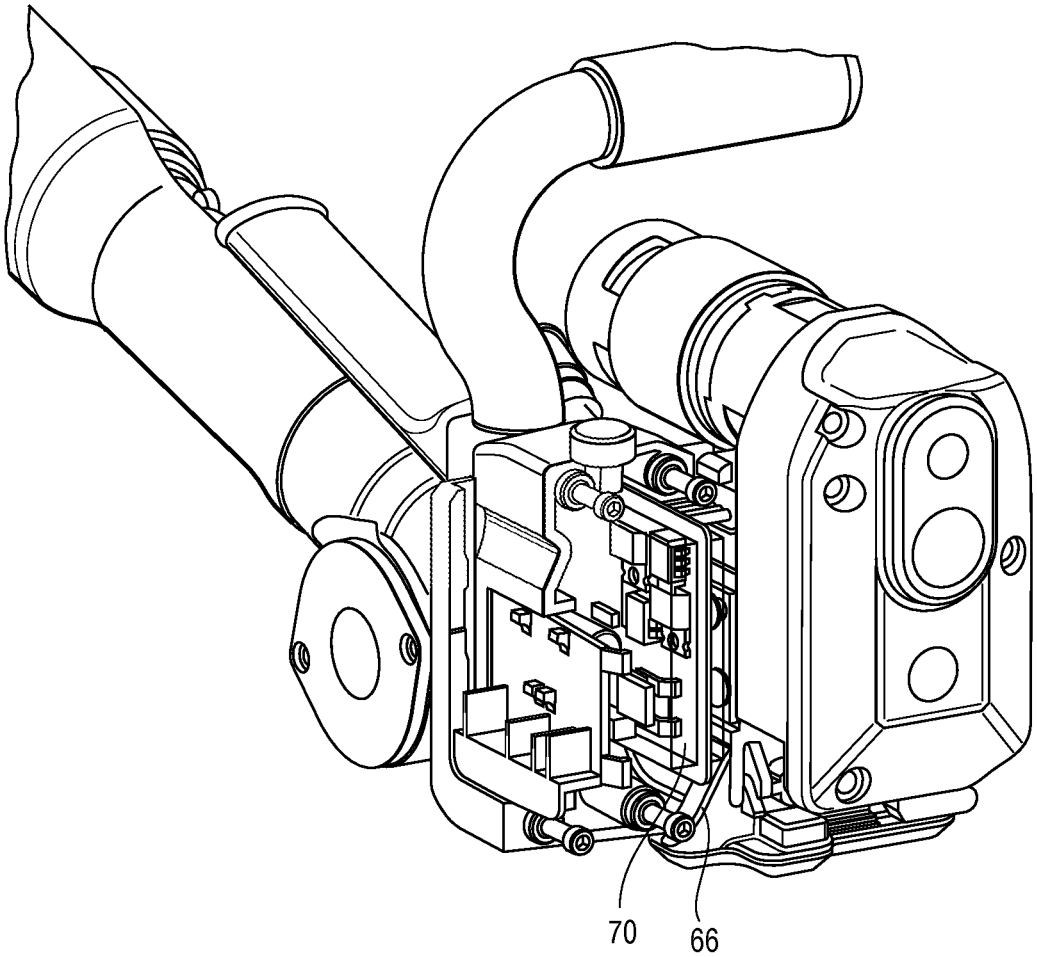
FIG. 6 is a rear perspective view similar to FIG. 3 showing portions of the housing removed for clarity of illustration.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Referring now to the figures, an embodiment of the electrically powered combination strapping tool 10 is shown. The tool 10 is configured to tension steel strap S or strapping material around an object or load L, seal overlapping portions of the strap S to itself at a seal or joint J to form a tensioned loop around the load L and to cut the tensioned loop from the strap supply P. Generally, the strap S includes a feed or supply end P and a free end F that is fed around the load L and reinserted into the tool 10 to overlap the supply end P.

Figure 7:
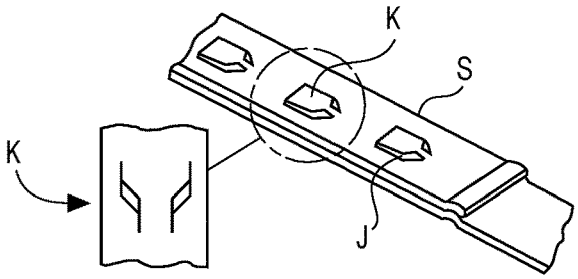
FIG. 7 is an illustration of the interlocking key arrangement formed in the overlapping courses of strap.

For purposes of the present disclosure, the term "sealless" refers to the configuration or type of seal or joint that is made in the overlapping portions of the strap. Although a "seal" is made in the strap courses, the sealless joint is made by cutting or punching interlocking keys K or sections of the courses, as illustrated in FIG. 7. The term sealless is intended to define this type of joint or seal J as compared to a joint that is made using a separate element such as a crimp seal that is applied over and crimped onto the overlapping strap courses.

The tool 10 includes a body 12, a tensioning section 14 and a sealing section 16. The tensioning section 14 includes a housing 18 and a first or tensioner motor assembly 20 operably mounted to the body 12. The sealing section 16 includes a sealer 21, housing 22 and a second or sealer motor assembly 24 operably mounted to the body 12. The body 12 includes a foot 26, a housing 28 and one or more handles 30 and 32 to facilitate handling and using the tool 10. One handle can be a tool opening handle 30 above the tensioner motor assembly 20 and the other an operating handle 32 mounted above the body 12. A receiver 34 is formed as part of or mounted to the body 12 for receiving a battery 36 or other power source. A temporary hold-down finger 38 can be positioned on the foot 12, opposite the tensioner motor assembly 20. The hold-down finger can be biased toward the foot 26.

The tensioning section 14 includes the tensioner motor assembly 20, which has a motor 40, such as a DC motor, and a gear housing 42 including a gear set 44 to convert the motor 40 output drive to a usable speed. The gear 44 set can include a planetary gear set (not shown) to reduce the output speed and to increase the output power or torque from the motor 40. The gear set 44 includes a final drive (not shown) that meshes with a gear (not shown) on a tension wheel 46. The tension wheel 46 is mounted normal to the final drive. The gear set 44 and final drive are housed in the gear housing 18 mounted to the tool body 12. A gripping pad 48 can be positioned in the foot 26, opposite the tension wheel 46.

The tensioner motor assembly 20, gear housing 42 and tension wheel 46 are movably mounted to the body 12 to move the tension wheel 46 toward and away from the foot 26. This permits the tool 10 to be opened to position the strap S between the foot 26 and the tension wheel 46. In an embodiment, the tensioner motor assembly 20, gear housing 42 and tension wheel 46 are pivotably mounted to the body 12 to pivot the tension wheel 46 toward and away from the foot 26. The tensioner motor assembly 20, gear housing 42 and tension wheel 46 can be biasedly mounted to the body 12, such as by a spring (not shown), to bias the tension wheel 46 toward the foot 26 and into contact with the strap S in the closed position.

The sealing section 16 includes the sealer motor assembly 24 which has a motor 50, such as a DC motor and a drive 52. In an embodiment, the drive 52 is a gear set 54 that includes a planetary gear set (not shown) that drives a cam shaft 56 through a final drive gear (not shown). The planetary gear set reduces the output speed and increases the output power or torque from the motor 50. Other drives can be used to transfer power from the motor 50 to the cam shaft 56, such as belts, chains or the like.

Figure 8:
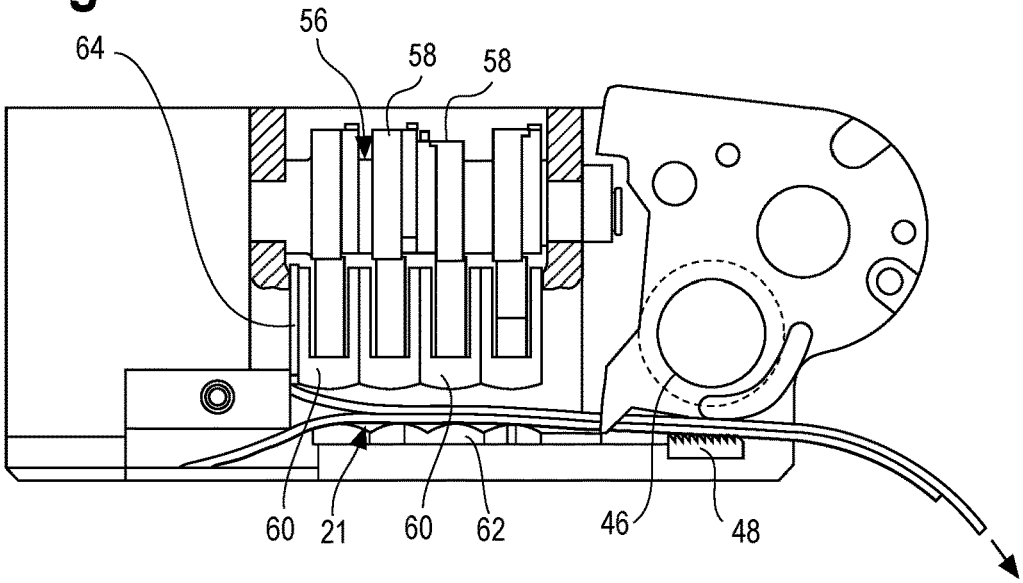
FIG. 8 is an illustration showing portions of the sealing and tensioning sections of the tool.

Cams 58 on the cam shaft 56 contact and moves a set of dies 60 in the sealing section 16. The dies 60 reciprocate toward and away from a punch 62 located on the foot 26 to bring the dies 60 into and out of contact with the overlapping course of strap S positioned between the dies 60 and the punch 62. When the dies 60 engage the strap S (in a sealing portion of the cycle), the dies 60 and punch 62 form keys K in the strap S that, when shifted longitudinally, lock into one another. An example of a sealer section 16 is illustrated in FIG. 8 and an example of an interlocking key K seal or joint J is illustrated in FIG. 7. The sealing section 16 also includes a cutter 64 to cut the looped and sealed strap S from the strap supply P during the sealing cycle. Similar to the dies 60, the cutter 64 is driven by the rotation of the cam shaft 56.

The tool 10 is configured to permit operation in fully automatic and manual modes. To this end, the tool 10 includes a control system, shown generally at 66, to control operation of the tool 10. In an embodiment the tool 10 includes an actuation 68 switch and one or more circuits 70, 72 to control the tensioner motor 40 and the sealing motor 50. In an embodiment, the tensioner motor and sealing motor circuits 70, 72 are provided on separate boards within the tool 10. It will be appreciated that the tensioner and sealer motor boards 70, 72 can be combined on a single board.

The control system 66 can further include a cam position switch or sensor 74 to sense the position of the cam shaft 56 in the sealing section 16, a strap size/tension adjustment device 76, an anti jam device 78 and a dynamic brake 80. The cam position switch 74 is positioned to determine the position of the cam shaft 56 and thus the position of the cam lobes 58 (or cams), and consequently the dies 60 and cutter 64. The strap size/tension adjustment device 76 can be, for example, a knob-type dial adjustment provided on the tool body 12. Control of the anti jam device 78 can be incorporated within the tension/strap size adjustment dial 76. The dynamic brake 80 is associated with the sealing motor 50 to brake or stop the motor 50 when the cam shaft 56 is at a home position and to bleed power from the motor 50 at the completion of the sealing cycle. The tool 10 can further include one or more indicators, such as LEDs, to provide indication of certain functions and states of the tool. An LED indicator 82 can be positioned within or around the actuation switch 68.

Referring to FIG. 10, in an operating scenario, the tool 10 is in a home position in which the spring biases the tension wheel 46 into contact with the foot 26. When the battery is installed, as at step 102, the tool 10 turns on and runs a self-test, as at step 104. An indicator, such as the LED 84 in the actuation switch 68, can be configured to flash in a predetermined sequence to indicate the operating state of the tool 10. For example, the LED 84 can flash once to indicate that the tool 10 is in an automatic operating mode and twice to indicate that the tool 10 is in a manual operating mode. Once the tool 10 completes the self-test it is in a ready/sleep state as at step 106. In the ready/sleep state, the tensioner and sealer motors 40 and 50 are off (no power to the motors), and the tool 10 is ready for operation in an automatic mode or a manual mode.

Figure 9:
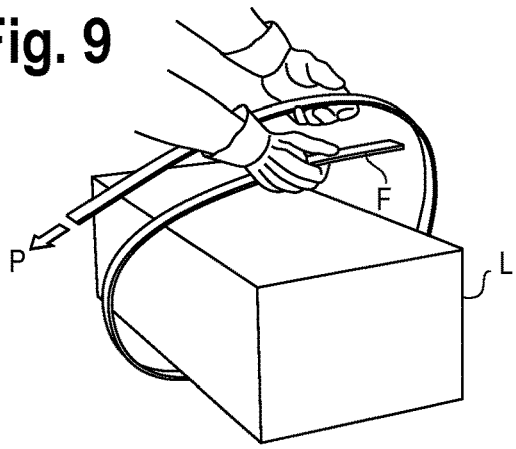
FIG. 9 illustrates the positioning of the strap around a load.

To commence a strapping cycle, the tool 10 is opened by urging or pulling the tensioner motor assembly 20 toward the tensioner handle 30 to open a gap between the tension wheel 46 and the foot 26. A lead or free end F of the strap S is positioned around the load and a supply end P of the strap S (from a strap dispenser) is positioned overlapping the free end F. The overlapping courses of strap S are positioned in the tool 10 between the tension wheel 46 and the foot 26 and between the dies 60 and punch 62 with the supply end P entering from the rear end (the tension wheel 46 end) of the tool 10 as illustrated in FIGS. 8 and 9, with the strap S courses positioned under the hold-down finger 38.

In one scenario of an automatic mode, depressing and releasing the actuation switch 68 commences the operating cycle. With overlapping strap S courses positioned between the tension wheel 46 and the foot 26 and between the dies 60 and punch 62, the tension cycle starts, as at step 108, in which the tensioner motor 40 operates to drive the tension wheel 46 to draw tension in the strap S. As the tensioner motor 40 operates, the actuation switch LED 84 is illuminated. When a predetermined amount of tension is drawn (as set by using the strap size/tension adjustment knob 76), the tensioner motor 40 stops and the LED indicator 84 goes out.

The sealing cycle then starts, as at step 110, in which the sealing motor 50 operates to rotate the cam shaft 56 and the cams 58 move into contact with and move the dies 60 downward to contact the strap S. When the sealing motor 50 starts, the actuation switch LED 84 illuminates to indicate tool 10 operation. The interlocking keys K are cut by the force of the cams 58 on the dies 60 forcing the dies 60 into the strap S and forcing the strap S against the punch 62. The strap supply P end is cut to separate the looped strap S from the strap supply P.

The sealing motor 50 continues to operate, and when the cam shaft 56 completes one full (360 degree) revolution, the cam switch or sensor 74 is triggered and the sealing motor 50 turns off. The dynamic brake 80 stops the cam shaft 56 at the home position by absorbing excess energy from the sealing motor 50. The hold-down finger 38 at the foot 26 holds the strap S temporarily in place in the tool 10. Once sealing is complete, the tensioner motor 40 operates in reverse for a short period (less than about 1 second) to allow the tension in the strap S to "pull" the keys K into an interlocking arrangement (see, FIG. 7), which forms the seal or joint J.

Once the sealing cycle is completed, as at step 112, with the dies 60 returned to the home position and the sealing motor 50 stopped, the LED indicator 84 goes out. The tool 10 is then in the ready/sleep state.

In automatic mode, depressing and releasing the actuation switch 68 at any time during the tension and/or sealing cycles (see, steps 108 and 110), can, for example, stop the tool 10, and depressing and holding the actuation switch 68, as at step 114, can operate the tensioner motor 40 in reverse. This functions as an emergency stop of the tool 10.

The tool 10 can also be operated in manual mode in which, for example, a first depression of the actuation switch 68 commences the tension cycle, and the tensioner motor 40 stops when a predetermined tension is reached. In this example of manual operation, a second depression of the actuation switch 68 may then be required to commence the sealing cycle. The auto-stop functions (for example, depressing and/or depressing and holding the actuation switch) can again serve to stop the tool 10 and/or reverse the tensioner motor 10 in manual mode.

With reference to the trigger functions and events referenced in FIG. 10, Trigger Function (1) (•) when in Ready mode 106, will begin the tensioning cycle; Trigger Function (2) (–) when in Ready mode 106, will cause the tool to reverse until the trigger is released; and Trigger Function (3) (•) at any time during the tension cycle will stop the motor, where (•) indicates that the trigger is held for less than a specified period of time and (–) indicates that the trigger is held for more than a specified period of time.

(*) Automatic mode—after tensioning tool automatically seals. Manual mode—after tensioning tool waits for a second trigger event to activate sealer motor. (**) Tension knob—selects strap width, mode and option to only activate sealer motor.

As noted above, the tool 10 can include an anti jam feature 78 actuation of which can be incorporated into the strap size/tension adjusting device 76. When the anti-78 jam function is selected and the actuation switch 68 is depressed, the tensioner motor 40 operates in reverse to clear any material that may be jammed in the tool 10, between the tension wheel 46 and the foot 26. The sealing motor 50 will cycle once, also to clear any material that may be jammed in the tool 10.

The tool 10 as disclosed and described is an electrically powered tool that uses a battery 36; it will however be appreciated that the tool 10 can be configured to operate with a voltage converter (not shown) for example, for use at line voltages (e.g., 120V-240V). In addition, although the tool 10 is described as including a tensioner motor 40 and a sealing motor 50, it is contemplated that a single motor can be used to carry out both the tension and sealing functions with appropriate drives in place.

It will also be appreciated by those skilled in the art that various other automatic and manual operating scenarios are and can be contemplated in connection with the disclosed electrically powered combination hand-held strapping tool 10, and that such other operating scenarios are within the scope and spirit of the present disclosure.

It should be understood that various changes and modifications to the presently preferred embodiments disclosed herein will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A strapping tool for tensioning and forming a sealless joint in overlapping sections of strap around a load, the strapping tool comprising:

a body;

a tensioning wheel rotatable in a first direction during a tensioning cycle and a second direction opposite the first direction;

a sealer comprising a die and a punch configured to cooperate with one another to cut keys in the overlapping sections of the strap during a sealing cycle; and a control system configured to sequentially drive the tensioning wheel and the sealer to carry out the tensioning and sealing cycles responsive to receipt of a single operator input and to, following the sealing cycle, drive the tensioning wheel in the second direction to cause the keys cut in the overlapping sections of strap to interlock.

2. The strapping tool of claim 1, further comprising one or more motors operably connected to the tensioning wheel and the sealer and configured to drive the tensioning wheel and the sealer, wherein the control system is configured to control the one or more motors.

3. The strapping tool of claim 1, further comprising a tensioner motor and a sealer motor, wherein the tensioner motor is operably connected to the tensioning wheel and configured to drive the tensioning wheel, and wherein the sealer motor is operably connected to the sealer and configured to drive the sealer.

4. The strapping tool of claim 2, further comprising a tensioner gear set, wherein the one or more motors are operably connected to the tensioning wheel via the tensioner gear set.

5. The strapping tool of claim 4, wherein the tensioner gear set comprises a planetary gear set configured to reduce a speed and increase a torque of an output of the one or more motors.

6. The strapping tool of claim 1, wherein the body comprises a foot, and wherein the tensioning wheel is mounted to the body such that the tensioning wheel is movable relative to the foot between a strap-engagement position and a strap-insertion position.

7. The strapping tool of claim 6, wherein the tensioning wheel is adjacent to the foot when in the strap-engagement position and spaced apart from the foot when in the strap-insertion position.

8. The strapping tool of claim 7, further comprising a spring that biases the tensioning wheel to the strap-engagement position.

9. The strapping tool of claim 8, wherein the foot comprises the punch.

10. The strapping tool of claim 1, wherein the sealer further comprises a cam shaft comprising a cam that engages the die, wherein the cam is shaped such that the die moves toward and away from the punch during a rotation of the cam shaft.

11. The strapping tool of claim 10, further comprising a strap cutter driven by the cam shaft.

12. The strapping tool of claim 10, further comprising:

one or more motors operably connected to the tensioning wheel and the sealer to drive the tensioning wheel and the cam shaft; and a cam-position switch configured to sense the rotational position of the cam shaft.

13. The strapping tool of claim 12, further comprising a dynamic brake, wherein the control system is configured to, responsive to the cam-position switch sensing that the cam shaft has returned to a home position following completion of the sealing cycle, control the dynamic brake to stop the one or more motors.

14. The strapping tool of claim 1, further comprising an actuation switch configured to receive the single operator input.

15. The strapping tool of claim 14, wherein the actuation switch comprises a mechanical pushbutton.

16. The strapping tool of claim 14, wherein the control system is configured to sequentially drive the tensioning wheel and the sealer to carry out the tensioning and sealing cycles responsive to receipt of the single operator input when in an automatic operating mode.

17. The strapping tool of claim 14, wherein the control system is configured to drive the tensioning wheel to carry out the tensioning cycle responsive to a first operator input and to drive the sealer to carry out the sealing cycle responsive to receipt of a second operator input when in a manual operating mode.

18. The strapping tool of claim 17, further comprising a lighting device, wherein the control system is configured to activate the lighting device.

19. The strapping tool of claim 18, wherein the control system is configured to activate the lighting device in a first predetermined sequence when in an automatic operating mode and in a second different predetermined sequence when in the manual operating mode.

20. The strapping tool of claim 19, wherein the lighting device at least partially surrounds the actuation switch.

* * * * *